US005486062A

United States Patent [19]

Tsurumaru

[11] Patent Number: 5,486,062

[45] Date of Patent: Jan. 23, 1996

[54] PRINTER-CONTAINING APPARATUS

[75] Inventor: Shinichiro Tsurumaru, Kawasaki, Japan

[73] Assignee: Fujitsu Limited, Kawasaki, Japan

[21] Appl. No.: 291,860

[22] Filed: Aug. 17, 1994

[30] Foreign Application Priority Data

Oct. 29, 1993 [JP] Japan ..... 5-271487

[51] Int. Cl.[6] ..... B41J 15/16

[52] U.S. Cl. ..... 400/618; 400/613.1

[58] Field of Search ..... 400/618, 613.1, 400/613, 619, 615.2, 615.1, 614, 613.1, 611

[56] References Cited

U.S. PATENT DOCUMENTS

| | | | |
|---|---|---|---|
| 4,372,694 | 2/1983 | Bovio et al. | 400/613.1 |
| 4,904,100 | 2/1990 | Enix | 400/613 |
| 5,111,216 | 5/1992 | Richardson et al. | 400/613 |
| 5,201,588 | 4/1993 | Sakai et al. | 400/613 |

FOREIGN PATENT DOCUMENTS

| | | | |
|---|---|---|---|
| 3107134 | 9/1982 | Germany | 400/613 |
| 0092084 | 7/1981 | Japan | 400/613 |
| 0055277 | 4/1983 | Japan | 400/613 |
| 59374 | 2/1990 | Japan | 400/613 |
| 5229195 | 9/1993 | Japan | 400/613 |
| 2229401 | 9/1990 | United Kingdom | 400/613 |

*Primary Examiner*—Edgar S. Burr
*Assistant Examiner*—Anthony H. Nguyen
*Attorney, Agent, or Firm*—Armstrong, Westerman, Hattori, McLeland & Naughton

[57] ABSTRACT

An apparatus is disclosed in which a printer in which roll paper having no core bar is used is contained. When a leading end of roll paper placed on a roll paper accommodation section passes a roll paper introduction portion opened in a printer housing, a guide provided integrally on a cover limits the width of the passage of the leading end thereby to prevent jam of the roll paper.

4 Claims, 2 Drawing Sheets

PRINTER-CONTAINING APPARATUS

BACKGROUND OF THE INVENTION

1. Field of the Invention

This invention relates generally to a portable apparatus such as a hand-held terminal, and more particularly to an apparatus in which a printer in which roll paper is used is contained.

2. Description of the Related Art

In recent years, portable apparatus in which a printer is contained such as a hand-held terminal have been put into practical use. In portable printer-containing apparatus of the type mentioned, since the printer is not always driven in a condition wherein it is placed on a table or a like place, it is required for the apparatus to prevent occurrence of paper jam in what manner the apparatus is used.

Conventionally, as one of apparatus in which a printer in which roll paper is used as a printing paper is contained, an apparatus wherein roll paper having a core bar is used with the core bar set in position on bearings of the apparatus is known.

Meanwhile, taking it into consideration that the operation of setting a core bar in position onto bearings is cumbersome, also another apparatus in which roll paper having no core bar is used is employed. An apparatus in which roll paper having no core bar is used includes, for example, a roll paper accommodation section for receiving roll paper, a printer housing having a roll paper introduction portion opened therein for introducing a leading end of roll paper into the printer therethrough, and a cover mounted for opening and closing movement relative to the roll paper accommodation section.

The apparatus of the type just described is advantageous in that, since roll paper used has no core bar, it is easy to exchange roll paper. However, the apparatus is disadvantageous in that roll paper is liable to suffer from jamming at the roll paper introduction portion.

SUMMARY OF THE INVENTION

It is an object of the present invention to provide a printer-containing apparatus wherein roll paper can be exchanged readily and jam of roll paper seldom occurs.

In accordance with the present invention, there is provided an apparatus in which a printer in which roll paper is used as a printing paper is contained, which comprises a roll paper accommodation section for receiving roll paper having a leading end, a printer housing having a roll paper introduction portion opened therein for introducing the leading end of the roll paper into the printer therethrough, a cover mounted for opening and closing movement on the roll paper accommodation section, and a guide provided integrally on the cover for limiting the width of the passage of the leading end of the roll paper at the roll paper introduction portion.

According to the present invention, since use of roll paper having no core bar is allowed, it is easy to exchange roll paper. Further, since the guide for limiting the width of the passage of a leading end of roll paper at the roll paper introduction portion is provided, jam of roll paper seldom occurs.

The above and other objects, features and advantages of the present invention and the manner of realizing them will become more apparent, and the invention itself will best be understood, from a study of the following description and appended claims with reference to the attached drawings showing some preferred embodiments of the invention.

DESCRIPTION OF THE PREFERRED EMBODIMENT

In the following, an embodiment of the present invention will be described with reference to the drawings.

Figure 1:
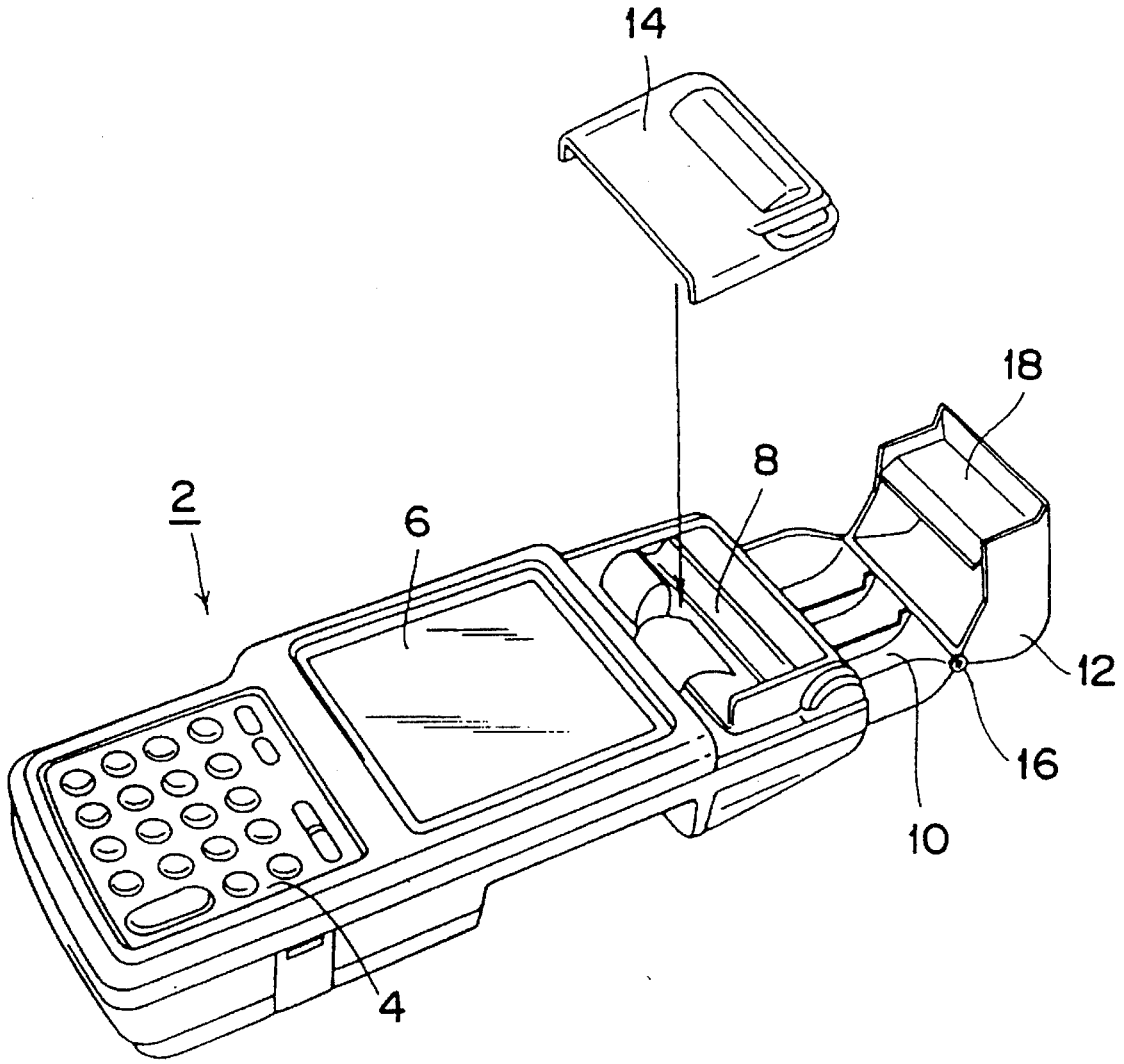
FIG. 1 is an exploded perspective view of a hand-held terminal to which the present invention is applied.

FIG. 1 is an exploded perspective view of a hand-held terminal (handy terminal) showing an embodiment of the present invention. The hand-held terminal 2 includes, in order from the front when it is held by hand, an operation section 4 including input means such as ten keys, a display section 6 constituted from a liquid crystal display or a like member, a printer 8, a roll paper accommodation section 10 for receiving roll paper therein, and a cover 12 mounted for opening and closing movement relative to the roll paper accommodation section 10. Meanwhile, reference numeral 14 denotes a printer cover removably mounted on the printer 8. In the present embodiment, the cover 12 is mounted for pivotal motion around a shaft 16 relative to the roll paper accommodation section 10, and a guide 18 which is characteristic in the present invention is provided integrally on the inner side of the cover 12.

Figure 2:
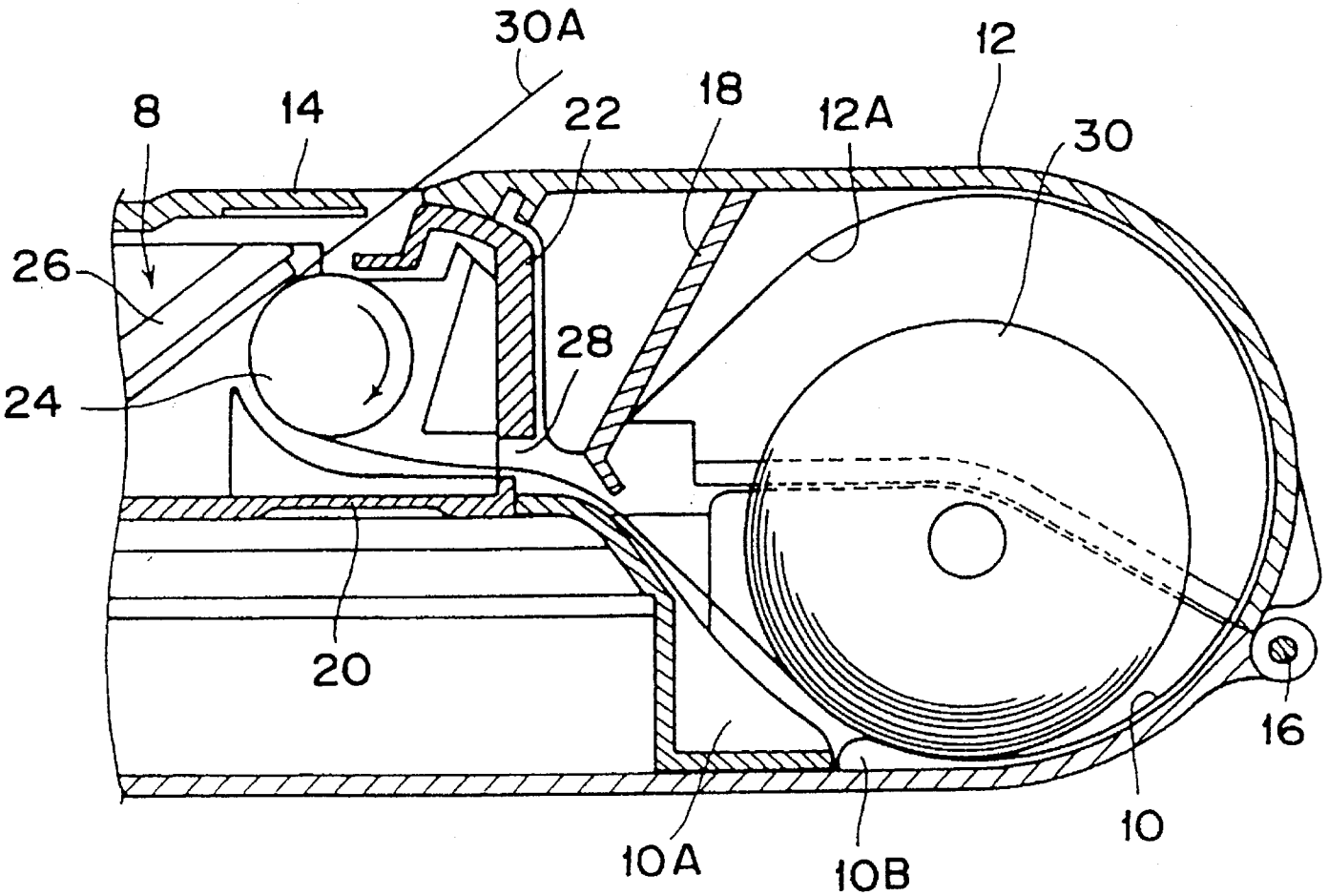
FIG. 2 is a sectional view of essential part of the hand-held terminal shown in FIG. 1.

FIG. 2 is a sectional view of essential part of the hand-held terminal 2 of FIG. 1. The printer 8 is constituted from a lower printer housing 20 and an upper printer housing 22 both incorporated in a body housing of the present apparatus, and a platen roll 24 and a printer head 26 covered with the housings 20 and 22. The printer head 26 is, for example, of the thermal transfer type. A roll paper introduction portion 28 is opened between the lower housing 20 and the upper housing 22 for introducing a leading end 30A of roll paper 30 placed on the roll paper accommodation section 10 into the printer 8 therethrough.

The leading end 30A of the roll paper 30 is wrapped around the platen roll 24 past the roll paper introduction portion 28 and is fed out to the outside of the apparatus past a printing station between the platen roll 24 and the printer head 26. The roll paper introduction portion 28 has a sufficient width (opening dimension in the vertical direction in FIG. 2) in order to facilitate insertion of the leading end 30A of the roll paper 30 into the printer 8.

In the present embodiment, the cover 12 can be pivoted open around the shaft 16, and only if roll paper 30 is placed onto the roll paper accommodation section 10 and the leading end 30A of the roll paper 30 is forwarded into the roll paper introduction portion 28, then the printer 8 is put into a printing enabled condition by a feeding operation of the platen roll 24 in the direction indicated by an arrow mark, and accordingly, setting of the roll 30 is very easy. On the other hand, if the cover 12 is closed as shown in FIG. 2 upon printing operation of the printer 8 on the roll paper 30, then since the guide 18 integral with the cover 12 is positioned so that it limits the width of the passage of the leading end of the roll paper at the roll paper introduction portion 28, the roll paper 30 is prevented from jamming at the roll paper introduction portion 28 or the like which is caused by inadvertent vibrations of the roll paper 30 in the roll paper accommodation section 10 or by some other cause.

A pair of ribs 10A and 10B each in the form of a plate extending in parallel to the plane of FIG. 2 are formed on the roll paper accommodation section 10 while a rib 12A similarly extending in parallel to the plane of FIG. 2 is provided integrally on the cover 12 and the guide 18. Consequently, when the apparatus is used in a horizontal condition as shown in FIG. 2, a lower portion of the roll paper 30 contacts with the rib 10A or 10B, and in this condition, the leading end 30A of the roll paper 30 is forwarded into the printer 8. Since the ribs 10A and 10B are each in the form of a plate, the frictional force between the ribs 10A and 10B and the surface of the roll paper 30 is comparatively low, and accordingly, even where a small motor of the power saving type is used as a driving source for the platen roll 24, the roll paper can be forwarded into the printer 8 well without causing a slip or the like. Though not shown, when the present apparatus is used in an uprightly standing condition, the lower portion of the roll paper 30 contacts with the rib 12A of the cover 12 and the rib 10A of the roll paper accommodation section 10, and a good forwarding operation of the roll paper is realized similarly to the case wherein the apparatus is used in a horizontally laid condition.

As described so far, according to the present invention, there is an advantage in that a printer-containing apparatus wherein exchange of roll paper is easy and roll paper seldom undergoes jamming at the roll paper introduction portion.

While, in the foregoing description, the present invention is described in connection with the preferred embodiment, this is illustrative but not limitative. For example, while, in the embodiment described above, the cover is mounted for pivotal motion relative to the roll paper accommodation section, alternatively the cover may be removably mounted on the roll paper accommodation section. The scope of the present invention is defined in the claims annexed hereto, and all modifications and alterations which belong to the range of equivalence of the claims all remain within the scope of the present invention.

What is claimed is:

1. An apparatus in which a printer in which roll paper is used as a printing paper is contained, comprising:

a roll paper accommodation section for receiving roll paper having a leading end having a rib for reducing the friction between said roll paper accommodation section and the roll paper;

a printer housing having a roll paper introduction portion opened therein for introducing the leading end of the roll paper into said printer therethrough;

a cover pivotally mounted for opening and closing movement on said roll paper accommodation section, said cover having a rib for reducing the friction between said cover and the roll paper; and a guide provided integrally on said cover for limiting the width of the passage of the leading end of the roll paper at said roll paper introduction portion.

2. A hand-held portable terminal in which roll paper is used as a printing paper is contained, comprising:

a printer;

a roll paper accommodation section for receiving roll paper having a leading end having a rib for reducing the friction between said roll paper accommodation section and the roll paper;

a printer housing having a roll paper introduction portion opened therein for introducing the leading end of the roll paper into said printer therethrough;

a cover mounted for opening and closing movement on said roll paper accommodation section;

said cover having a rib for reducing the friction between said cover and the roll paper and a guide provided integrally on said cover for limiting the width of the passage of the leading end of the roll paper at said roll paper introduction portion.

3. The hand-held portable terminal of claim 2, further comprising input means for inputting data, wherein said printer is responsive to said input means.

4. The hand-held portable terminal of claim 3, further comprising a display, responsive to said input means.

* * * * *